US005453591A

United States Patent [19]

Stroud

[11] Patent Number: 5,453,591

[45] Date of Patent: Sep. 26, 1995

[54] SENSING STRUCTURE FOR COMPONENT WEAR IN HIGH VOLTAGE CIRCUIT INTERRUPTERS

[75] Inventor: Nicholas J. Stroud, Greensburg, Pa.

[73] Assignee: ABB Power T&D Company Inc., Blue Bell, Pa.

[21] Appl. No.: 222,836

[22] Filed: Apr. 5, 1994

[51] Int. Cl.[6] ..... H01H 33/70; H01H 33/88

[52] U.S. Cl. ..... 218/43; 218/48; 218/53; 218/57; 218/62; 218/63; 218/72; 218/74

[58] Field of Search ..... 200/144 R, 148 R, 200/148 A, 148 B

[56] References Cited

U.S. PATENT DOCUMENTS

| | | | |
|---|---|---|---|
| 3,665,134 | 5/1972 | Fischer | 200/148 A |
| 3,721,786 | 3/1973 | Yoshioka | 200/148 A |
| 3,842,226 | 10/1974 | Yoon | 200/148 R |
| 4,236,053 | 11/1980 | Sasaki et al. | 200/144 R |
| 4,412,115 | 10/1983 | Ukuno | 200/148 A |
| 4,418,256 | 11/1983 | Graf | 200/148 R |
| 4,420,662 | 12/1983 | Niemeyer et al. | 200/148 R |
| 4,445,019 | 4/1984 | Gaupp et al. | 200/148 A |
| 4,467,158 | 8/1984 | Kobayashi et al. | 200/148 A |

*Primary Examiner*—J. R. Scott

*Attorney, Agent, or Firm*—Woodcock, Washburn, Kurtz, Mackiewicz & Norris

[57] ABSTRACT

A vaporizable material, for example, a silicone, that is buried beneath the surface of a Teflon nozzle for a sulfur hexafluoride power circuit breaker in an area of the nozzle which is exposed to abrasion and wear due to arc products. In a similar manner, aluminum or titanium or some other vaporizable material is buried beneath the surface of the contact of the circuit interrupter which is exposed to abrasion and wear. When the buried layers are exposed due to abrasion of their covering surfaces, these materials will be vaporized and their presence will be sensed by sensors within the circuit interrupter, thus revealing some predetermined degree of wear of the surfaces of the nozzle and contact and other surfaces within the circuit interrupter which may also be subject to abrasion by arcing or arc products. When aluminum is used as the vaporizable material for the contact, it also senses the presence of flashover to aluminum exterior housings.

20 Claims, 2 Drawing Sheets

SENSING STRUCTURE FOR COMPONENT WEAR IN HIGH VOLTAGE CIRCUIT INTERRUPTERS

BACKGROUND OF THE INVENTION

This invention relates to high voltage circuit interrupters, and more specifically relates to a novel structure for indicating the amount of wear of critical interrupter surfaces due to erosion by arcing and gaseous arc products.

Surfaces of interrupter structures, such as those using sulfur hexafluoride as an interrupting medium, are subject to wear and erosion due to arcing and hot gases due to the arc which play on such surfaces. This erosion requires frequent maintenance inspection to determine the degree of erosion and whether such parts need replacement. Two key components which are particularly subject to this problem are the Teflon nozzle, which channels gas flow during the interruption operation of the circuit breaker, and the metallic arcing contact. The inspection process requires that the circuit breaker be taken out of service and the opening of this sealed chamber containing the interrupter, and the partial disassembly of the interrupter assembly.

SUMMARY OF THE INVENTION

In accordance with the present invention, a vaporizable tracer material, which is a substance different from that of the component with which it is associated, is buried beneath the surface of the component which is subject to erosion. Thus, when the surface has been sufficiently eroded away to expose the insert, the vaporization products produced during interruption will contain traces of the tracer insert. These vapors are sensed by appropriate measuring equipment associated with the circuit interrupter to reveal that the critical components have worn by a predetermined dimension and that the breaker requires maintenance, thus reducing unnecessary down time due to unnecessary maintenance.

When the invention is applied to the nozzle structure of a sulfur hexafluoride ($SF_6$) power circuit breaker interrupter, the nozzle is commonly made of Teflon. The Teflon nozzle is modified in such a manner as to maintain its mechanical and electrical integrity by building into the nozzle, layers or pockets of silicone or a similar material which, when exposed to the arc, will produce silicon tetrafluoride. The existence of this gas can be easily sensed with appropriate sensing equipment contained within the circuit breaker and sensing can be performed either continuously or on a routine periodic basis by permanent sensors, or by sensors installed through a suitable port in the interrupter housing when monitoring is desired. When the presence of the silicon tetrafluoride or other arc product is sensed, the breaker will be known to require servicing.

In a similar manner, the arcing contacts which are especially subject to arc erosion are commonly made of tungsten and copper alloys. This structure is modified to contain a buried layer of a material such as aluminum or titanium beneath the surfaces most likely to erode. Thus, once the main arcing contact has eroded beyond a given amount, the aluminum or titanium layer is exposed and, as erosion continues, aluminum fluoride or titanium fluoride will be produced which can be easily sensed.

As a further advantage of the invention, when using aluminum as the arcing contact insert, the same equipment which senses the presence of aluminum due to the production of aluminum fluoride can also sense internal flashover within an aluminum tank or housing for the circuit breaker interrupter. While the invention is disclosed in connection with $SF_6$ filled interrupters, it will be apparent that it can also be used with other gas ambients, including air.

Other features and advantages of the present invention will become apparent from the following description of the invention which refers to the accompanying drawings.

DETAILED DESCRIPTION OF THE INVENTION

Figure 1:
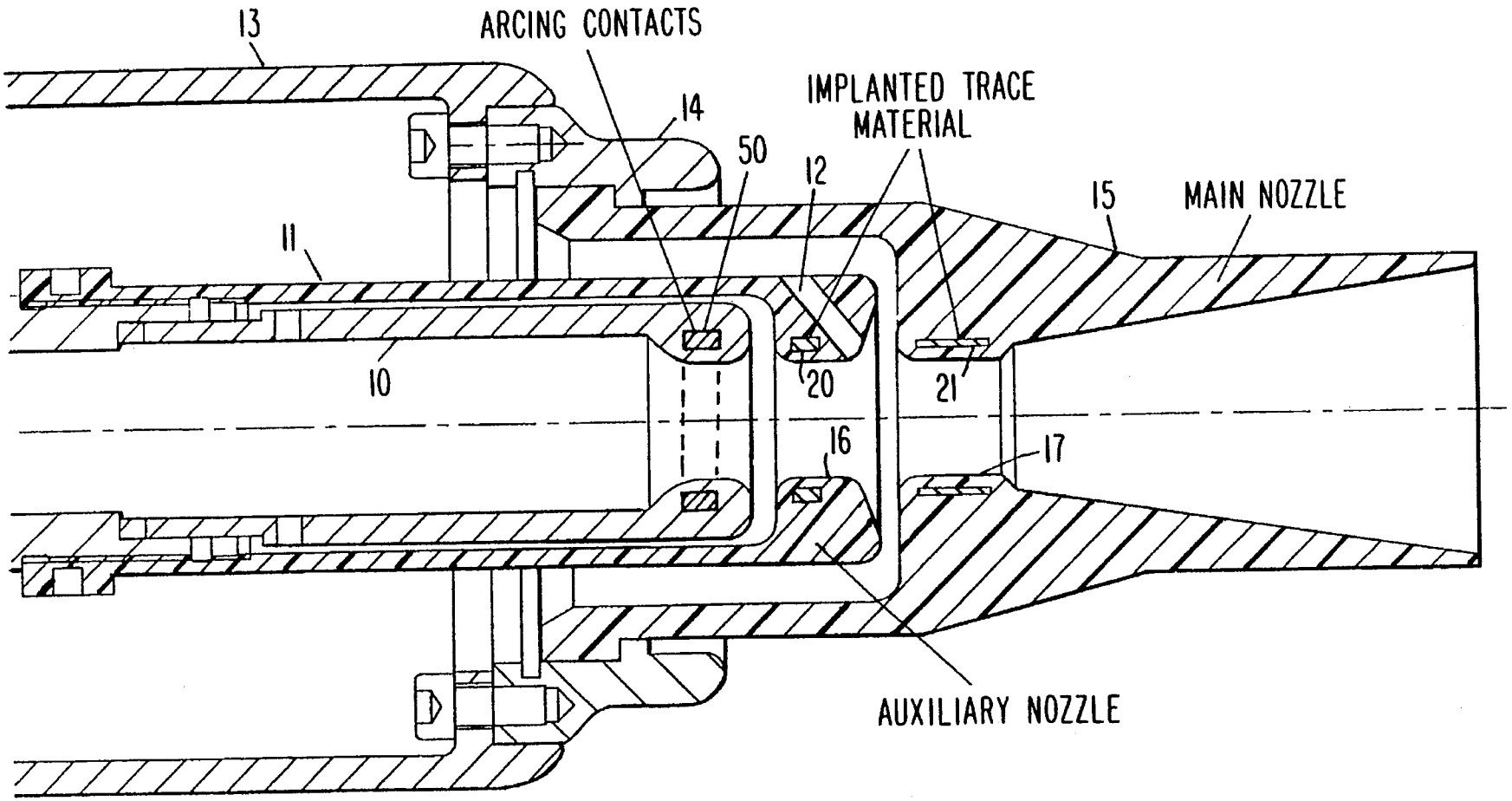
FIG. 1 is a cross-sectional view through the center line of a typical cylindrical sulfur hexafluoride circuit breaker interrupter nozzle assembly for a puffer-type circuit breaker.

Referring first to FIG. 1, there is shown therein a typical sulfur hexafluoride interrupter nozzle assembly which consists of a cylindrical array 10 of flexible arcing contacts which are fixed to and surrounded by an auxiliary insulation nozzle 11. Nozzle 11 is commonly of Teflon but can be of other high temperature resistant insulation materials. Nozzle 11 has a central opening through which sulfur hexafluoride gas will flow during an arcing interruption operation in a well-known manner. The right-hand end of the auxiliary nozzle 11 may contain auxiliary gas flow channels, such as the channel 12.

Also fixed to the arcing contact 10 and the auxiliary nozzle 11 is a conductive sleeve 13 which carries main contacts 14 at the right-hand end thereof. The main insulation nozzle 15, which is also preferably of Teflon, is fixed to the arcing contact cylinder 14.

During interruption operation, in which a movable contact is withdrawn relative to and from the assembly of FIG. 1 shown, there is severe arcing on the interior of auxiliary nozzle 11 and main nozzle 15 and hot interruption gas flow through nozzle 11. This severe arcing and hot gas tends to erode the interior diameters 16 and 17 of auxiliary nozzle 11 and main nozzle 15. These surfaces, however, must have dimensions which are designed to enhance the flow of sulfur hexafluoride gas therethrough during the interruption operation. Therefore, excessive erosion of surfaces 16 and 17 will interfere with the operation of the circuit breaker. Therefore, circuit breakers must be carefully maintained and disassembled on a periodic basis so that these surfaces can be examined.

In accordance with the present invention, implanted trace materials, which are different from the material of the nozzles 11 and 15, are implanted beneath the surface of the nozzles. Thus, a ring 20 is implanted beneath the surface of region 16 of nozzle 11 and a ring 21 is implanted beneath the surface 17 of nozzle 15. These rings are of materials which are ionized by the arc and hot gas and arc products produced during arc interruption, but are of materials distinct from the materials of nozzles 11 and 15. Therefore, their combustion products, created during arcing if they are exposed to the arc, can be sensed.

In a preferred embodiment of the invention, nozzles 11 and 15 are of Teflon. Rings 20 and 21 are embedded in these Teflon bodies during the manufacture of the nozzles, or in any other suitable manner, and are preferably buried beneath the surfaces 16 and 17 by about 5–10 mm.

Figure 2:
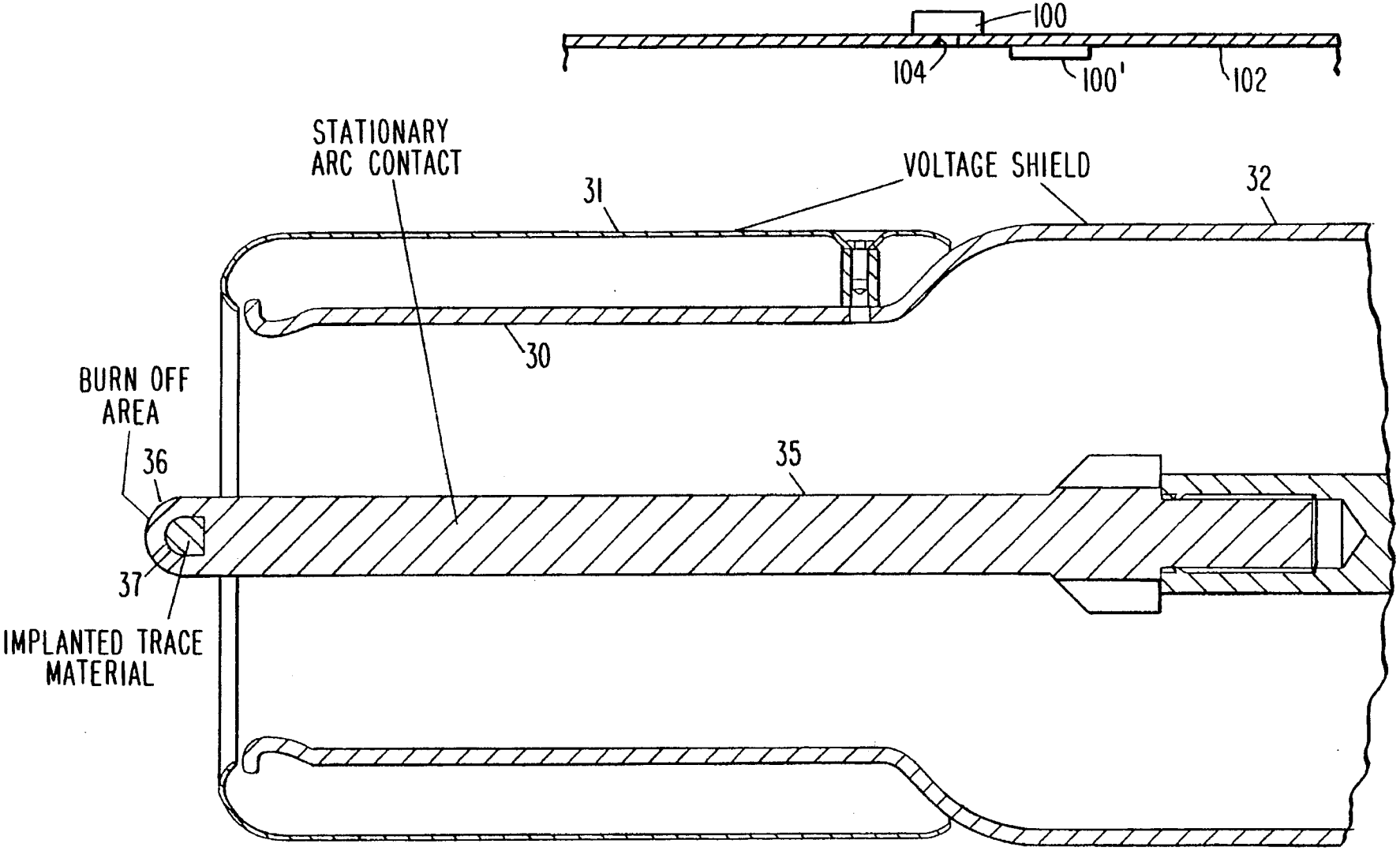
FIG. 2 is a cross-sectional view through the center line of the arcing contact and main contact assembly which cooperates with the nozzle assembly of FIG. 1 and which also employs the present invention.

In a preferred embodiment of the invention, rings 20 and 21 are of silicone which, when eroded in the presence of an arc and in sulfur hexafluoride, will produce silicon tetrafluoride, which is easily sensed by appropriate measuring equipment 100 (See FIG. 2). In FIG. 2, the measuring equipment or sensor 100 is diagrammatically shown on the outside of the partially and diagrammatically shown container or aluminum housing 102 and over the port 104 in the housing 102. The sensor 100, could also be located within container or housing 102 and this is illustrated in FIG. 2 with the sensor being shown diagrammatically at 100'. As noted in the Brief Description of the Drawings, FIG. 1 is a cross-sectional view through the center line of a typical cylindrical sulfur hexafluoride circuit breaker interrupter nozzle assembly for a puffer-type circuit breaker and FIG. 2 is a cross-sectional view through the center line of the arcing contact and main contact assembly which cooperates with the nozzle assembly of FIG. 1. It will be understood by those skilled in the art of high voltage circuit interrupters that the structure shown in FIG. 1 and the structure shown in FIG. 2 are both contained within the aluminum housing 102. The sensor 100/100' can be attached to the housing or tank wall 102 at any suitable location and anywhere connected to or in gaseous communication with the gas volume to be sensed. Other materials than silicone can be used and suitable tracer materials will be selected for gas ambients other than $SF_6$. Moreover, other shapes can be used in place of rings 20 and 21. For example, rings which are triangular in cross-section and having their apexes pointing toward the axis of the insulation bodies can be used so that, as erosion continues, a greater and greater surface area of the erodible ring is exposed, thus producing a measure of the diameters 16 and 17 over a period of time based on the quantity of tracer gas which is produced during interruption. Other shapes can be used. Moreover, the rings need not be continuing.

Once products are sensed by sensor 100/100' in the container (102 see FIG. 2) of the sulfur hexafluoride gas indicating erosion of the sensing rings 20 and 21, maintenance should be performed on the circuit breaker, and these parts can be replaced.

The novel invention may also be carried out in monitoring the erosion of the stationary arcing contact of the circuit interrupter, as is shown in FIG. 2. Referring to FIG. 2, the assembly shown therein is the arcing contact assembly and has main contact fingers formed in the cylinder 30 which move axially with respect to the device in FIG. 1, with the fingers 30 engaging the stationary main contacts 14 in FIG. 1. Conductive cylindrical voltage shields 31 and 32 are fixed to the main movable contacts 30.

An arcing contact 35, which can be of any copper alloy adapted to be resistant to arcing, is arranged to be fixed to and to move with the movable contacts 30 in any suitable well-known manner, not shown. The end 36 of the arcing contact 35 passes through diameters 16 and 17 of the insulation nozzles of FIG. 1 and enters the interior of the stationary arcing contact 10.

In practice, the end 36 of the arcing contact 35 is subject to burn-off and arc erosion due to the arc and arc products created during arc interruption more so than other areas of the contact structure Accordingly, in accordance with the present invention, a novel implant of trace material 37 is fixed within and buried under the surface of the burn-off area 36 of the arcing contact 35.

As was the case in FIG. 1, the trace material 37 will be of a material which, when eroded by an arc in sulfur hexafluoride, will produce a vapor distinct from other vapors produced during interruption, thus indicating that the implant 37 has been exposed and that the stationary contact has been burned off to a degree which requires replacement.

The trace material 37 is buried within the end of the arcing contact 35 in any desired manner. Preferably, the implanted trace material can be either aluminum or titanium or some similar material that will produce a fluoride of the metal during erosion. Thus, if aluminum is used for the trace material 37, it will produce aluminum fluoride during arcing if the trace is exposed. A titanium trace implant will produce titanium fluoride. Both of these vapors are easily sensed by suitable monitoring equipment within the housing 102 which contains the contacts and gas of the interrupter.

In many cases, the housing for the interrupter is an aluminum housing, usually a casting. If aluminum is used as the implanted trace material 37, it will have the further advantage of making the sensing equipment sensitive to an internal flashover to the aluminum casing or tank or housing 102 of the circuit breaker if such a tank is also of aluminum.

Note that, in FIG. 2, the trace material 37 will have a surface which is parallel to the curvature of the outer end of the stationary contact. Therefore, erosion sufficient to expose the surface of trace material 37 at any point over the burn-off area will produce an excessive wear signal, no matter where on the arc the contact material is worn through to the trace material 37.

It is also possible to bury an insert ring 50 in the interior surface of arcing contact 10 of FIG. 1. The ring will be of material similar to that of trace material 37.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. In a circuit interrupter having components which can erode due to exposure of their surfaces to electrical arcs and hot arc products; a buried layer of tracer material contained below the surface of at least one of said components of said circuit interrupter which is exposed to arcing or arc products during the operation of said circuit interrupter; said buried layer having a chemical composition which is different from that of said at least one of said components; a surface portion of said buried layer being vaporized by electrical arcs and hot arc products when the material of said one of said components is worn away to expose said surface portion of said buried layer; the vaporized material of said buried layer being capable of being sensed and distinguished from vaporized arc products of the material of said one of said components.

2. The device of claim 1 wherein said one of said components is disposed in a sulfur hexafluoride gas ambient.

3. The device of claim 1 which further includes sensing means to sense the presence of the vaporized products of said buried layer.

4. The device of claim 2 which further includes sensing means to sense the presence of the vaporized products of said buried layer.

5. The device of claim 1 wherein said one of said components is an insulation cylinder having a central opening therethrough to channel the flow of hot ionized gas during arc interruption; said buried layer consisting of a ring buried below and around the surface of said central opening.

6. The device of claim 2 wherein said one of said components is an insulation cylinder having a central opening therethrough to channel the flow of hot ionized gas during arc interruption; said buried layer consisting of a ring buried below and around the surface of said central opening.

7. The device of claim 5 which further includes sensing means to sense the presence of the vaporized products of said buried layer.

8. The device of claim 5 wherein said insulation cylinder is of Teflon and said trace material is silicone.

9. The device of claim 6 wherein said insulation cylinder is of Teflon and said trace material is silicone.

10. The device of claim 9 which further includes sensing means to sense the presence of the vaporized products of said buried layer.

11. The device of claim 1 wherein said one of said components is an arcing contact rod of a first conductive material; said rod having a burn-off end area; said buried layer consisting of a metal other than said first conductive material disposed beneath the surface of said burn-off end area.

12. The device of claim 11 wherein said buried layer is aluminum.

13. The device of claim 11 wherein said buried layer is titanium.

14. The device of claim 11 wherein said one of said components is disposed in a sulfur hexafluoride gas ambient.

15. The device of claim 11 which further includes sensing means to sense the presence of the vaporized products of said buried layer.

16. The device of claim 12 wherein said one of said components is disposed in a sulfur hexafluoride gas ambient.

17. The device of claim 13 wherein said one of said components is disposed in a sulfur hexafluoride gas ambient.

18. The device of claim 16 which further includes sensing means to sense the presence of the vaporized products of said buried layer.

19. The device of claim 17 which further includes sensing means to sense the presence of the vaporized products of said buried layer.

20. The device of claim 18 which further includes an aluminum housing enclosing said circuit interrupter and being spaced from said interrupter and being insulated therefrom at least partly by said sulfur hexafluoride gas ambient.

* * * * *